US007832024B2

(12) United States Patent
Chow

(10) Patent No.: US 7,832,024 B2
(45) Date of Patent: Nov. 16, 2010

(54) SYSTEM FOR GENERATING FOAM

(76) Inventor: Meng Chow, 198 Pasir Panjang Road, #02-05, Singapore 117526 (SG)

( * ) Notice: Subject to any disclaimer, the term of this patent is extended or adjusted under 35 U.S.C. 154(b) by 887 days.

(21) Appl. No.: 10/581,780

(22) PCT Filed: Oct. 6, 2004

(86) PCT No.: PCT/SG2004/000325

§ 371 (c)(1),
(2), (4) Date: Apr. 12, 2007

(87) PCT Pub. No.: WO2005/054592

PCT Pub. Date: Jun. 16, 2005

(65) Prior Publication Data

US 2008/0040844 A1 Feb. 21, 2008

(30) Foreign Application Priority Data

Dec. 4, 2003 (SG) ..... 200307303-8

(51) Int. Cl.
*E03D 9/02* (2006.01)

(52) U.S. Cl. ..... 4/223; 4/222; 222/145.5; 222/145.6

(58) Field of Classification Search ..... 4/223, 4/225.1; 222/145.6, 145.5
See application file for complete search history.

(56) References Cited

U.S. PATENT DOCUMENTS 3,383,710 A * 5/1968 Carmichael ..... 4/300.3
3,695,288 A * 10/1972 Billeter et al. ..... 137/360
3,762,875 A 10/1973 Burmeister
3,778,849 A 12/1973 Foley
4,208,747 A 6/1980 Dirksing
4,305,162 A 12/1981 Cornelisse, Jr. et al.
4,321,714 A 3/1982 Takai et al.
4,453,278 A 6/1984 Doggett et al.
4,491,988 A 1/1985 Mizuno
4,534,071 A 8/1985 Russomanno
4,571,752 A * 2/1986 Bick ..... 4/300
4,707,865 A 11/1987 Ludwig et al.
4,965,894 A * 10/1990 Baus ..... 4/605

(Continued)

FOREIGN PATENT DOCUMENTS

AU 1834883 A 2/1984

(Continued)

*Primary Examiner*—Gregory L Huson
*Assistant Examiner*—Karen Younkins
(74) *Attorney, Agent, or Firm*—Schiff Hardin LLP

(57) ABSTRACT

A system capable of generating foam in a sanitary appliance includes a dosing device previously filled with a foaming substance, the dosing device metering a dosage of the substance, an agitation mechanism to agitate the substance to create foam, a receptacle to retain the substance for communication with the agitation mechanism, a fluid supply to allow fluid transport of the substance to the receptacle, and a trigger for activating the fluid supply. A dosing device of this system is further provided, including a container filled with a foaming substance, a positioner to position and house the container, the positioner further including a pin capable of creating a bottom aperture of the container, a fluid supply, wherein the outlet of the fluid supply is directed at the aperture on the bottom end of the container. A container is also provided that can be used in the dosing device.

18 Claims, 3 Drawing Sheets

U.S. PATENT DOCUMENTS

| | | | | |
|---|---|---|---|---|
| 5,603,126 | A * | 2/1997 | Scoggins | 4/225.1 |
| 5,918,320 | A * | 7/1999 | Reals | 4/225.1 |
| 2003/0084505 | A1 * | 5/2003 | Conway et al. | 4/605 |
| 2004/0040074 | A1 * | 3/2004 | Leonard et al. | 4/231 |

FOREIGN PATENT DOCUMENTS

| | | | |
|---|---|---|---|
| CN | 2428535 | | 5/2001 |
| DE | 30 41 951 | | 6/1981 |
| DE | 30 18 048 | | 11/1981 |
| DE | 3018048 | A1 | 11/1981 |
| DE | 37 22 452 | | 1/1989 |
| DE | 40 07 137 | | 9/1991 |
| DE | 4007137 | A1 | 9/1991 |
| DE | 199 38 913 | | 3/2001 |
| JP | 2003253727 | A | 9/2003 |

* cited by examiner

SYSTEM FOR GENERATING FOAM

BACKGROUND

The invention relates to a system for dosing a substance and creating a foam into a sanitary appliance.

It is well known to provide dispensers for releasing substances, such as bleaches, cleaners or disinfectants gradually or intermittently into toilet bowls. These substances are either dispensed on their own or dispensed together with the water when the toilet is flushed. These substances that are dispensed may be perfumed, colored, or pre-mixed with chemical additives that inhibit staining of the toilet bowl or to discourage microbiological growth.

Dispensers that are predominant in the market are the solid block types. Some of these are placed into the bottom of a tank of a sanitary appliance, where they slowly dissolve and migrate into the tank water by diffusion. Similarly, another type of solid block type of dispenser is adaptable to be held near the rim of the bowl of a sanitary appliance. Mixing occurs when the toilet is flushed, and the flushing water will mix with these blocks to create a solution that is introduced into the bowl. A known problem of these methods of dispensing is that they do not make efficient use of the chemical blocks, and most of the mixed solution is flushed away.

More recent improvements involve the isolation between the substances and the surrounding tank water.

For isolated dispensers, an isolation means is used to separate the chemical solutions from the main tank of water. Generally, air-locks using the concept of U-tubes are used to create this isolation. Examples of this are found in U.S. Pat. Nos. 4,208,747; 4,707,865; 4,305,162; 4,453,278; and 3,778,849. Other types of passive dispensers involve valves that regulate the flow of the solution in response to the water level within the tank. Examples of this type of dispenser are disclosed in U.S. Pat. Nos. 4,491,988 and 4,534,071. However, as these dispensers work in response to the water level within the tank, the solution will be dispensed regardless of whether a user wishes the solution to be dispensed. Again, this results in waste and accelerated depletion of the solution.

The solution dispensed may or may not cause foam. This foam is required to abate the noise and splashes associated with the deposit of solid waste into the bowl of a sanitary system, which can be a source of embarrassment to some.

Foam may be created by the addition of foaming ingredients such as carbonate or bicarbonate and an acid, such as oxalic or citric acid, as well as bonding materials, for example, a gum or high viscosity methylcellulose, and foam stabilizers, for example, saponin or licorice, to the water contained in the toilet bowl. However, these additional chemicals may be hazardous to the environment, and cause potential health effects during accidental human contact.

SUMMARY

It is an object of the present invention to alleviate and ameliorate the above problems.

According to various embodiments of the invention, there is provided a system for generating foam in a sanitary appliance including a dosing device previously filled with a substance capable of foaming, the dosing device capable of metering a dosage of the substance, an agitation mechanism to agitate the substance to create foam, a receptacle to retain the substance for communication with the agitation mechanism, a fluid supply to allow fluid transport of the substance to the receptacle, and a triggering mechanism for activating the fluid supply.

Preferably, the dosing device includes a container for containing the substance. Furthermore, the dosing device may further include a positioner to maintain a position of the container, the positioner further including an opening at a bottom end of the positioner. In one preferred embodiment, the positioner further includes a piercing mechanism to extend through the opening at the bottom end of the positioner. In another preferred embodiment, the fluid supply further includes a first outlet and a second outlet. Preferably, the first outlet is directed at the opening at a bottom end of the positioner. Also, the second outlet may be directed at an inlet of the agitation mechanism.

In a further preferred embodiment, the agitation mechanism is a head with a plurality of spray channels. Preferably, the agitation mechanism may be positioned at an elevation to the receptacle. The system may further include a funneled container to contain and direct the foam generated in the receptacle directly into the sanitary appliance. The form generated may be directed to an overflow pipe of the sanitary appliance. Furthermore, the form generated may be directed to the cistern of the sanitary appliance.

In a preferred embodiment, the triggering mechanism is a valve. The triggering mechanism for activating the fluid supply may be manually activated. Furthermore, the manually activated triggering mechanism for activating the fluid supply may be a push valve. In another preferred embodiment, the triggering mechanism for activating the fluid supply may be electronically activated. Preferably, the electronically activated triggering mechanism for activating the fluid supply is triggered by a detector.

In yet another preferred embodiment, the detector for activating the triggering mechanism is a motion detector, such that when a user is within a detectable area, the triggering mechanism will activate the system for generating foam in a sanitary appliance.

Preferably, where in use, the container for containing the substance capable of foaming is positioned in the positioner, and the piercing mechanism on the positioner creates an aperture on the container.

Another embodiment of the invention provides a dosing device adaptable to be used in a system for generating foam, including a container that has been previously filled with a substance capable of foaming, a positioner to position and house the container, the positioner further including a substantially vertically extending pin, the pin capable of creating an aperture at a bottom end of the container; and a fluid supply, wherein the outlet of the fluid supply is directed at the aperture on the bottom end of the container.

Preferably, where in use, the container is put in the positioner and the pin creates an aperture on a bottom end of the container. This permits easy handling of the container by the user, and when in use, an aperture can easily be created to form the dosing device. The container may further include a protrusion extending from a bottom end of the container, and the aperture may be on the protrusion so that fluid from the fluid supply can easily be directed towards the aperture. Another embodiment of the invention includes a container adapted to be used in a dosing device of the present invention.

DESCRIPTION OF FIGURES

Embodiments of the invention are described, by way of example only, with reference to the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the embodiments of the present invention, numerous specific details are set forth in order to provide a thorough understanding. However, it will be obvious to one who is ordinarily skilled in the art that the present invention may be practiced without these specific details. In other instances, well known methods, procedures, components, and features have been described in detail as not to unnecessarily obscure aspects of the present invention.

Figure 1:
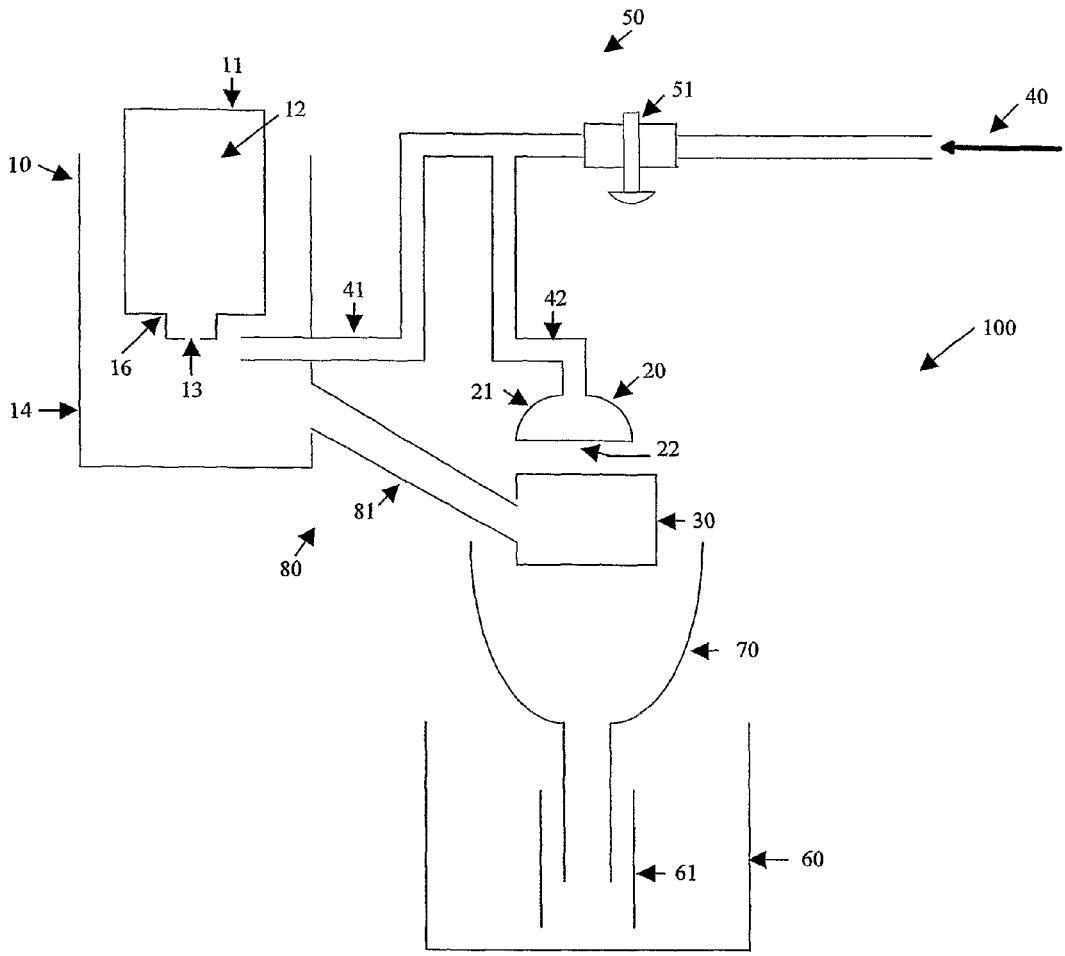
FIG. 1 is a pictorial schematic of the system for generating foam.

FIG. 1 shows the system for generating foam 100 according to a first aspect of an embodiment of the present invention. The system for generating foam 100 includes a dosing device 10 which is previously filled with a substance capable of foaming 12, an agitation mechanism 20, a receptacle 30 to retain the substance capable of foaming 12, a fluid supply 40 to introduce a fluid to fluidly transport the dosed substance capable of foaming 12 to the receptacle 30. When retained in the receptacle 30, the agitation mechanism 20 in the form of a shower head 21 and spray channels 22 will spray fluid from the fluid supply 40 to agitate the substance 12 admixed with a fluid to thus create a foam. This foam is then collected via a funneled container 70 and channeled directly to a cistern of the sanitary appliance 60. In a preferred embodiment shown in FIG. 1, the foam is channeled to an overflow pipe 61 of the sanitary appliance 60.

Figure 3:
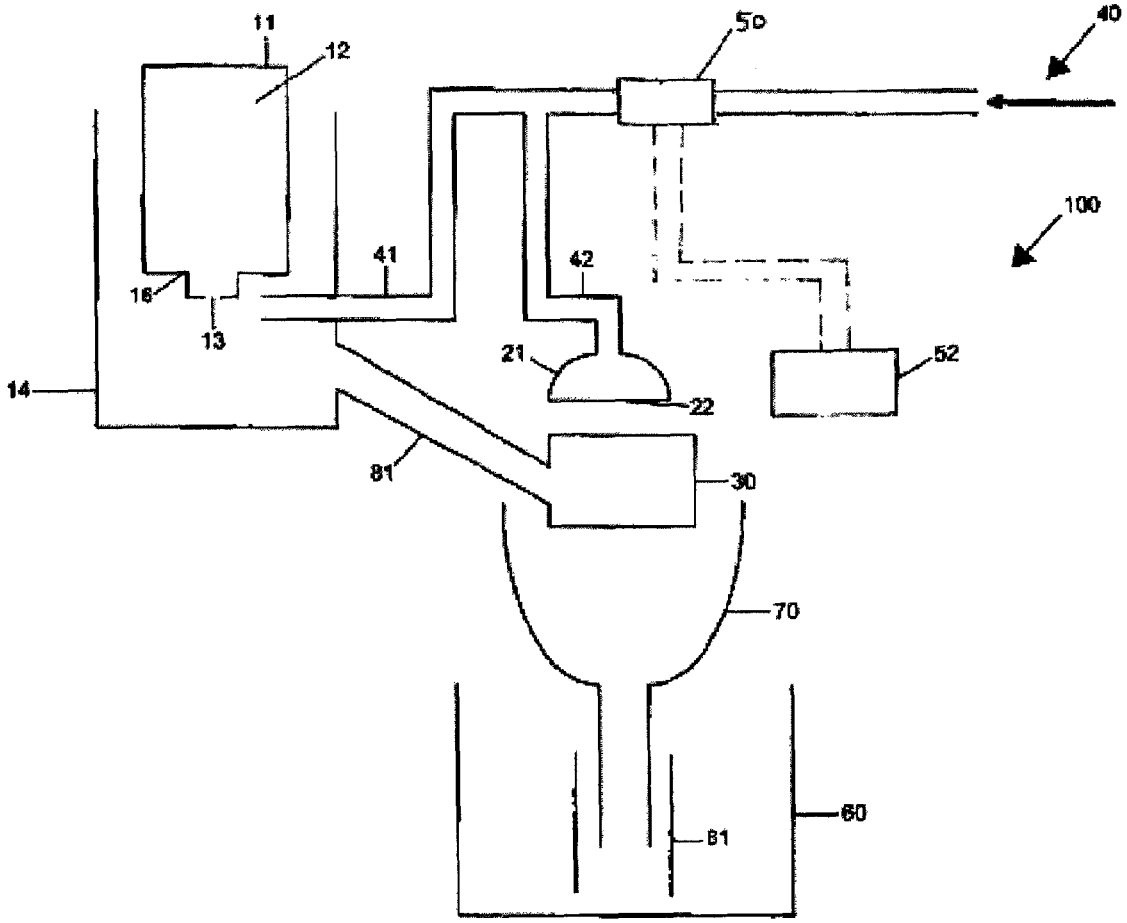
FIG. 3 is a schematic diagram of an alternative embodiment of the system of FIG. 1.

The fluid supply 40 is branched so that there is a first outlet 41 and a second outlet 42. The first outlet 41 and the second outlet 42 is activated by a triggering mechanism 50, such that, the fluid supply 40 is in fluid communication with the first and second outlet. This triggering mechanism 50 is shown as a mechanical triggering mechanism, and for ease of manufacture, a push valve 51. As shown in FIG. 3, it is to be understood that the triggering mechanism 50 can be of an electronically activated triggering mechanism, and can trigger the device when the presence of a user is detected, for example, by a motion detector 52. Thus, when a user is within a detectable area, the electronically activated triggering mechanism 50 will activate the system.

In FIG. 1, the fluid supply is in a form of a piping system connected to a main fluid supply, and branched off to a first outlet 41 and second outlet 42. The first outlet 41 is directed to an aperture 13 of the container 11 of the dosing device 10. On fluid contact with the substance capable of foaming 12 maintained at the aperture 13 of the container 11, a small amount of the substance capable of foaming 12 is dispensed. The container 11 is previously filled with a substance capable of foaming 12 so that the interior of the container 11 is maintained at pressure in equilibrium with the atmosphere pressure. Thus, the contents of the container 11, will not flow out via the aperture 13, and it is only upon the impact of the fluid from the first outlet 41 that a small amount of substance capable of foaming 12 is dispensed. It can be appreciated that when fluid is not directed at the aperture 13 of the container 11, the substance capable of foaming 12 will be maintained within the container 11 due to the atmospheric pressure acting on the aperture 13 and towards the substance contained therein. When the triggering mechanism 50 is activated, fluid introduced by the fluid supply 40 enters the first outlet 41 directed at the aperture 13 of the container 11. The impact of the fluid on the aperture 13 causes a small amount of the substance 12 to be dispensed. Once dispensed, the rest of the substance capable of foaming 12 contained within the container 11 will flow towards the aperture 13 by virtue of the gravitational forces.

The fluid thus admixed with the substance capable of foaming 12 is introduced into the receptacle 30, via a connecting means 80, shown in FIG. 1 as a conduit 81. The mixed substance capable of foaming 12 is made more viscous, and is retained in the receptacle 30, and the agitation mechanism 20 is allowed to agitate the mixed substance capable of foaming. In the preferred embodiment of the invention, the agitation mechanism 20 is shown as a showerhead 21 with a plurality of spray channels 22. When the triggering mechanism 50 is activated, the fluid supply 40 is in fluid communication with the first outlet 41 and the second outlet 42. The first outlet 41 is connected to the dosing device 10, and the effect is as explained above. The second outlet 42 is connected to an agitation mechanism 20, and will activate the showerhead 21. Fluid thus exits the showerhead 21 via the plurality of spray channels 22, directed at the receptacle 30. The impact of the fluid leaving the spray channels 22 on the substance 12 contained in the receptacle 30 forms the agitation of the substance capable of foaming 12, thus creating a long lasting foam. The agitation mechanism 20 is preferably positioned at an elevation to the receptacle 30 so that the greater impact of the fluid will cause a greater agitation. However, it can be appreciated that the agitation mechanism 20 can equally be any device known in the art that can cause vigorous movement within the receptacle 30, and will work equally well without departing from the spirit of the invention.

The foam thus created overflows the receptacle 30, and directly into the cistern of the sanitary appliance. In the preferred embodiment of FIG. 1, the foam overflows into a funneled container 70, and then to an overflow pipe 61 of the sanitary appliance 60. Thus, it can be seen that the activation of the foam generating system is independent of the working of the sanitary appliance. This thus prevents unnecessary waste of the substance 12. Also, a user can have a choice of whether to have foam introduced or not by activating the triggering mechanism, if necessary.

Figure 2:
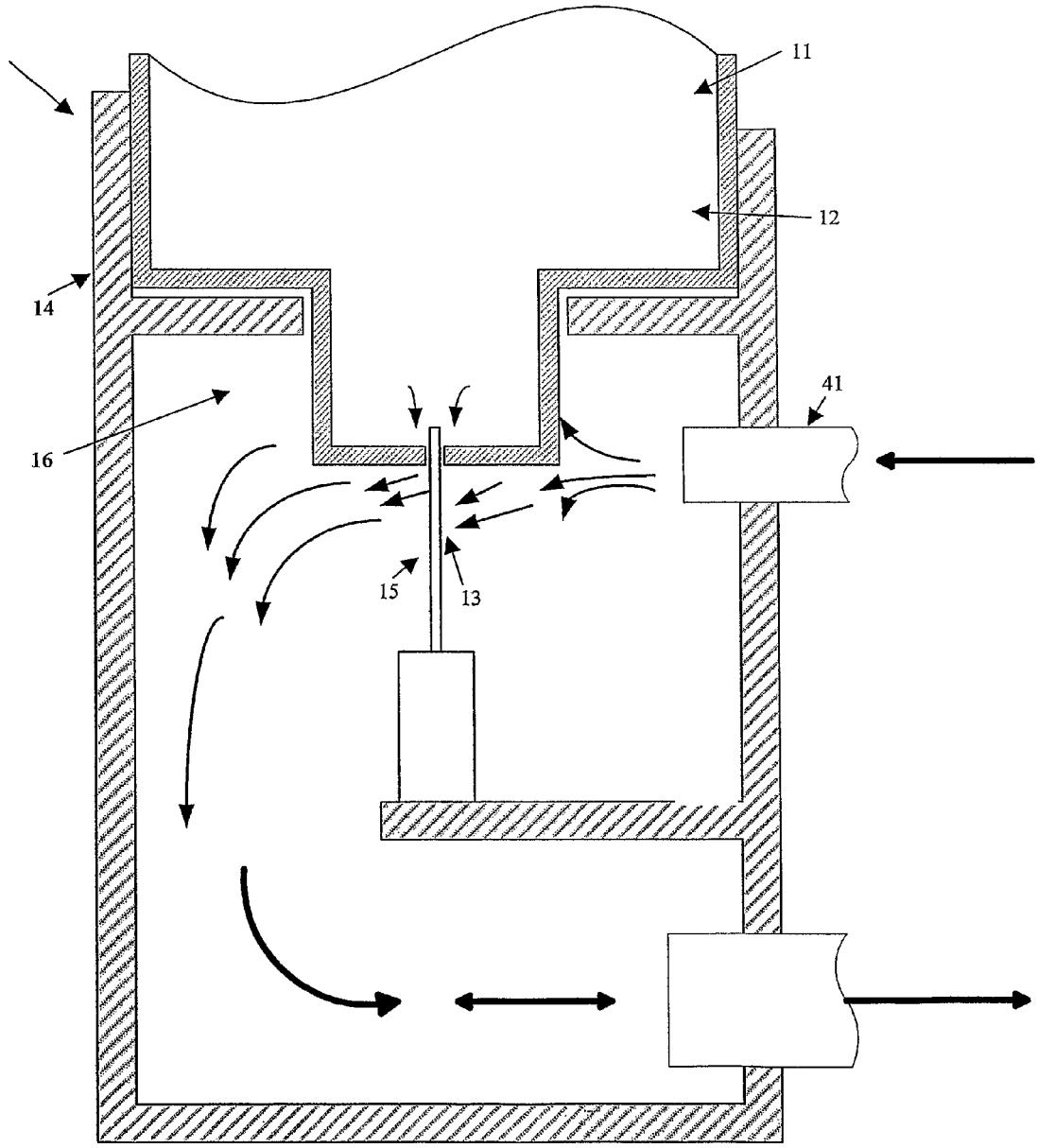
FIG. 2 is a pictorial schematic of the dosing device.

FIG. 2 is a view of the dosing device 10, which shows how the substance capable of foaming 12 is metered due to the impact of fluid from a first outlet 41 of the fluid supply 40. The container 11 is shown to be kept in place within a positioner 14. The positioner 14 further includes an upwardly extending pin 15, able to pierce through the bottom end of the container 11 to create an aperture 13. Thus, the container 11 can be sealed, and only when placing on the positioner 14 will the aperture 13 be created. However, it is also envisioned that the container 11 is previously provided with an aperture 13, and thus, inverted when placed within the positioner 14. To allow better wettability, it is preferred that the aperture 13 is positioned on a protruded portion 16 of the container 11. When the triggering mechanism 50 is activated, not shown in the figure, the fluid from the first outlet 41 is directed at the aperture 13, shown to be at a protruded portion 16 of the container 11. When the fluid is directed thus, the substance capable of foaming 12 near the aperture 13, is drawn out of the aperture 13 by virtue of the impact of the incoming fluid, to form a flowable substance. This flowable substance then exits the positioner 14 through the connecting means 80, shown as a conduit 81, and into the receptacle 30 for agitation and the creation of a lasting foam.

When the triggering mechanism 20 is not activated, fluid will not be allowed to pass through the first and second outlet. Thus, the substance capable of foaming 12 is maintained within the container 11 by virtue of the equilibrium pressure maintained within a dosing device previously filled with a substance capable of foaming, the dosing device capable of metering a dosage of the substance; an agitation mechanism to agitate the substance to create foam; a receptacle to retain the substance for communication with the agitation mechanism; a fluid supply to allow fluid transport of the substance to the receptacle; and a triggering mechanism for activating the fluid supply.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of components configured to perform the specified functions. The particular implementations shown and described herein are illustrative examples of the invention and are not intended to otherwise limit the scope of the invention in any way. For the sake of brevity, conventional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

The invention claimed is:

1. A system for generating foam in a sanitary appliance, comprising:

a dosing device operable to dispense a dosage of a substance capable of foaming, the dosing device including a container containing the substance capable of foaming and a positioner defining an opening in which said container is received;

a receptacle in fluid communication with said dosing device and capable of retaining a dispensed dosage of the substance capable of foaming;

an agitation mechanism operable to agitate the dispensed dosage of the substance capable of foaming in said receptacle;

a triggering mechanism operable to activate a first supply of fluid to supply the fluid into contact with the substance capable of foaming to dispense the dosage of the substance capable of foaming and transport the dosage to the receptacle, said triggering mechanism being operable to activate a second supply of fluid to supply the fluid to said agitation mechanism for the agitation mechanism to agitate the substance capable of foaming in the receptacle; and a first fluid outlet and a second fluid outlet, said first fluid outlet being directed at the opening in said positioner that receives said container to dispense the dosage of the substance capable of foaming, said second fluid outlet being directed at an inlet of said agitation mechanism.

2. A system for generating foam in a sanitary appliance according to claim 1, wherein said positioner further comprises:

a piercing mechanism to extend through the opening at the bottom end of said container.

3. A system for generating foam in a sanitary appliance according to claim 1, wherein said agitation mechanism comprises:

a head with a plurality of spray channels.

4. A system for generating foam in a sanitary appliance according to claim 1, wherein said agitation mechanism is positioned at an elevation to said receptacle.

5. A system for generating foam in a sanitary appliance according to claim 1, wherein said system further comprises:

a funneled container to contain and direct said foam generated in said receptacle directly into said sanitary appliance.

6. A system for generating foam in a sanitary appliance according to claim 5, wherein the sanitary appliance includes a cistern and wherein the foam generated is directed to the cistern of said sanitary appliance.

7. A system for generating foam in a sanitary appliance according to claim 5, wherein the foam generated is directed to an overflow pipe of said sanitary appliance.

8. A system for generating foam in a sanitary appliance according to claim 1, wherein said triggering mechanism is a valve.

9. A system for generating foam in a sanitary appliance according to claim 1, wherein said triggering mechanism for activating the fluid supply is manually activated.

10. A system for generating foam in a sanitary appliance according to claim 9, wherein said manually activated triggering mechanism for activating the fluid supply is a push valve.

11. A system for generating foam in a sanitary appliance according to claim 1, wherein said triggering mechanism for activating the fluid supply is electronically activated.

12. A system for generating foam in a sanitary appliance according to claim 11, wherein said electronically activated triggering mechanism for activating the fluid supply is triggered by a detector.

13. A system for generating foam in a sanitary appliance according to claim 12, wherein said detector for activating the triggering mechanism is a motion detector.

14. A dosing device, adaptable to be used in a system for generating foam in a sanitary appliance, the system including: a dosing device operable to dispense a dosage of a substance capable of foaming; a receptacle in fluid communication with said dosing device and retaining a dispensed dosage of the substance capable of foaming; an agitation mechanism operable to agitate the dispensed dosage of the substance capable of foaming in said receptacle and a triggering mechanism operable to activate a first supply of fluid to supply the fluid into contact with the substance capable of foaming to dispense the dosage of the substance capable of foaming and transport the dosage to the receptacle, said triggering mechanism being operable to activate a second supply of fluid to supply the fluid to said agitation mechanism for the agitation mechanism to agitate the substance capable of foaming in the receptacle, the dosing device further comprising:

a container that has been previously filled with the substance capable of foaming;

a positioner to position and house said container, said positioner further comprising a substantially vertically extending pin, said pin capable of creating an aperture at a bottom end of said container; and a fluid supply having an outlet;

wherein the outlet of said fluid supply is directed at said aperture on said bottom end of said container.

15. A dosing device as claimed in claim 14, where, in use, the container is put in said positioner and said pin creates an aperture on a bottom end of said container.

16. A dosing device as claimed in claim 14, wherein said container further comprises a protrusion extending from a bottom end of the container.

17. A dosing device as claimed in claim 16, wherein said aperture is on said protrusion so that fluid from the fluid supply can easily be directed at the aperture.

18. A dosing device as claimed in claim 14, wherein said container contains the substance capable of foaming.

* * * * *